US009853400B1

(12) United States Patent
Brodsky et al.

(10) Patent No.: US 9,853,400 B1
(45) Date of Patent: Dec. 26, 2017

(54) ELECTRICAL ARC PROTECTION USING A TRIP JUMPER

(71) Applicant: International Business Machines Corporation, Armonk, NY (US)

(72) Inventors: William L. Brodsky, Binghamton, NY (US); Byron S. Green, Poughkeepsie, NY (US); Robert K. Mullady, Highland, NY (US); Jeffrey A. Newcomer, Poughkeepsie, NY (US); Arkadiy O. Tsfasman, Wappingers Falls, NY (US); John S. Werner, Putnam Valley, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/340,021

(22) Filed: Nov. 1, 2016

(51) Int. Cl.
*H01R 11/00* (2006.01)
*H01R 13/703* (2006.01)
*H01R 13/44* (2006.01)

(52) U.S. Cl.
CPC ..... *H01R 13/703* (2013.01); *H01R 13/44* (2013.01)

(58) Field of Classification Search
CPC .... H01R 2103/00; H01R 29/00; H01R 31/06; H01R 25/003; H01R 31/08; G01R 1/20
USPC ..... 439/188, 189, 502, 505, 507, 508
See application file for complete search history.

(56) References Cited

U.S. PATENT DOCUMENTS 2,922,054 A * 1/1960 Miller ..... H01R 29/00 174/152 R
3,453,403 A * 7/1969 Hoffman ..... H02P 23/28 200/51 R
3,477,001 A * 11/1969 Haas ..... H02P 23/24 310/71
4,283,100 A * 8/1981 Griffin ..... H01R 31/08 361/823

(Continued)

FOREIGN PATENT DOCUMENTS

CN 103956619 A 7/2014
CN 205029123 U 2/2016

(Continued)

OTHER PUBLICATIONS

Brodsky, et al, "Electrical Arc Protection Using a Trip Contact", U.S. Appl. No. 15/340,006, filed Nov. 1, 2016.

(Continued)

*Primary Examiner* — Thanh Tam Le
(74) *Attorney, Agent, or Firm* — Michael Purdham

(57) ABSTRACT

A plug comprises power contacts and a trip jumper having jumper contacts configured to make a trip connection, during a plugging action with the plug and a receptacle, with mating trip contacts in the receptacle. When the receptacle is connected to electrical power during the plugging action, a current over the trip connection can cause disconnection of a receptacle power contact from the power. A receptacle comprises receptacle power contacts and a trip circuit having receptacle trip contacts configured to make a trip connection, during a plugging action with the receptacle and plug, with mating trip contacts in the plug. When the receptacle is connected to electrical power during the plugging action, a current over the trip connection can cause disconnection of power to a receptacle power contact. A (Continued)

system can have an electrical device with a line cord connected to the plug.

13 Claims, 7 Drawing Sheets

(56) References Cited

U.S. PATENT DOCUMENTS

| | | | | |
|---|---|---|---|---|
| 4,331,998 | A | 5/1982 | Matsko et al. | |
| 4,345,122 | A | 8/1982 | Janniello | |
| 4,346,419 | A | 8/1982 | Janniello | |
| 4,429,935 | A * | 2/1984 | Lamb | H01R 29/00 318/442 |
| 4,604,505 | A | 8/1986 | Henninger | |
| 4,748,355 | A * | 5/1988 | Anderson | H02K 5/225 310/71 |
| 4,907,985 | A | 3/1990 | Johnsen | |
| 4,937,482 | A * | 6/1990 | Dohogne | H01R 29/00 174/66 |
| 5,017,818 | A * | 5/1991 | Dohogne | H01R 29/00 310/71 |
| 5,185,705 | A | 2/1993 | Farrington | |
| 5,249,976 | A | 10/1993 | Brock | |
| 5,298,701 | A | 3/1994 | Sandor | |
| 5,476,392 | A | 12/1995 | Inaba et al. | |
| 5,602,427 | A * | 2/1997 | Dimitriev | B60Q 1/1415 307/10.8 |
| 5,711,681 | A * | 1/1998 | Hasegawa | H01R 31/08 439/507 |
| 5,818,671 | A | 10/1998 | Seymour et al. | |
| 5,835,567 | A * | 11/1998 | Woods | H04M 1/24 379/12 |
| 6,341,967 | B1 * | 1/2002 | Nabeshima | H01R 13/405 439/130 |
| 6,406,328 | B1 | 6/2002 | Attarian et al. | |
| 6,619,970 | B2 | 9/2003 | Fukushima et al. | |
| 6,746,275 | B2 | 6/2004 | Yamakawa | |
| 6,793,510 | B2 | 9/2004 | Yamakawa et al. | |
| 7,001,196 | B1 | 2/2006 | Huang | |
| 7,066,749 | B2 | 6/2006 | Borrego Bel et al. | |
| 7,134,919 | B2 * | 11/2006 | Putz | A61B 5/04001 439/682 |
| 7,422,491 | B2 * | 9/2008 | Gherardini | H01R 13/115 439/212 |
| 7,431,601 | B2 | 10/2008 | Nugent, Jr. et al. | |
| 7,817,055 | B1 | 10/2010 | Scanlon | |
| 7,955,102 | B2 | 6/2011 | Santos | |
| 8,193,445 | B2 | 6/2012 | Li | |
| 8,379,375 | B2 | 2/2013 | Furuya et al. | |
| 8,382,505 | B2 | 2/2013 | Park | |
| 8,460,027 | B2 * | 6/2013 | Topolewski | H01R 31/08 439/511 |
| 8,616,915 | B2 * | 12/2013 | Funamura | H01R 31/08 439/507 |
| 9,085,240 | B2 | 7/2015 | Rathmacher | |
| 9,260,080 | B2 | 2/2016 | Maguire et al. | |
| 2002/0079993 | A1 | 6/2002 | Toepfer | |
| 2007/0097582 | A1 | 5/2007 | Shipp et al. | |
| 2013/0088798 | A1 | 4/2013 | Ikeno et al. | |
| 2013/0148249 | A1 | 6/2013 | Schlotterer et al. | |
| 2013/0301165 | A1 | 11/2013 | Ford et al. | |

FOREIGN PATENT DOCUMENTS

| | | | |
|---|---|---|---|
| CN | 205646236 | U | 10/2016 |
| CN | 104103978 | B | 1/2017 |
| EP | 367102 | A2 | 5/1990 |
| JP | 2013105563 | A | 5/2013 |

OTHER PUBLICATIONS

List of IBM Patents or Patent Applications Treated as Related, Oct. 28, 2016. 2 pages.

Tsfasman et al., "Electrical Arc Protection Using a Rotational Shield", IBM U.S. Appl. No. 15/643,686, filed Jul. 7, 2017.

List of IBM Patents or Patent Applications Treated as Related, Aug. 1, 2017. 2 pages.

* cited by examiner

ELECTRICAL ARC PROTECTION USING A TRIP JUMPER

BACKGROUND

The present disclosure relates to electrical power plugs and receptacles. More specifically, the present disclosure relates to protecting against electrical arc during connection of a plug to, or disconnection of a plug from, a receptacle.

SUMMARY

Embodiments of the present disclosure (hereinafter, "embodiments") can prevent an electrical arc between a plug and receptacle. In one embodiment a power plug comprises plug power contacts and a trip jumper having two jumper contacts. The two jumper contacts are electrically coupled to each other to permit a current to flow through the trip jumper. A plugging action to connect or disconnect the plug and a power receptacle makes a "trip connection" between the two jumper contacts and respective mating trip contacts in the receptacle. When one or more power contacts in the receptacle is connected to electrical power from a power source, the trip connection permits a "trip current" through the trip jumper. The trip current can cause disconnection of one or more of the power contacts in the receptacle, connected to electrical power, from the power source.

In embodiments, one or both of the jumper contacts can be configured to break the trip connection when completing the plugging action, and when a trip current is present, breaking the trip connection can terminate the trip current. In some embodiments, connecting the plug and receptacle can make the trip connection prior to a power contact in the plug reaching a proximity to produce an electrical arc with any power contacts in the receptacle that are connected to electrical power. Alternatively, disconnecting the plug and receptacle can make the trip connection prior to power contacts in the plug prior to breaking contact with mating power contacts in the receptacle.

In some embodiments, the jumper contacts each have an electrically conductive region and an electrically non-conductive region. The two jumper contacts electrically conductive regions are electrically coupled to each other to electrically couple the two jumper contacts. During a plugging action, the two jumper contacts electrically conductive regions can make the trip connection with the respective mating receptacle trip contacts. The jumper contacts can be configured such that, when the plug and receptacle are fully connected, one or both of the trip jumper contacts electrically conductive regions do not make the trip connection with the respective mating receptacle trip contacts and one or both of the trip jumper contacts electrically non-conductive regions is placed in contact with the respective mating receptacle trip contacts to prevent a trip current through the trip jumper.

In alternative embodiments, a power receptacle comprises receptacle power contacts and a trip circuit having two trip contacts. A plugging action to connect or disconnect a plug and the receptacle makes a trip connection between each of the two receptacle trip contacts and respective mating jumper contacts in the plug. The trip connection permits a trip current through the two receptacle trip contacts when, during a plugging action, one or more power contacts in the receptacle is connected to electrical power from a power source. The trip current can cause disconnection of a receptacle power contact from the electrical power.

In such alternative embodiments, connecting the plug and receptacle can make the trip connection prior to a power contact in the plug reaching a proximity to produce an electrical arc with any power contacts in the receptacle that are connected to electrical power. Alternatively, disconnecting the plug and receptacle can make the trip connection prior to power contacts in the receptacle breaking contact with mating power contacts in the plug.

A system can include an electrical device having a line cord with a plug having a trip jumper. The line cord can include electrical wires to connect the electrical device to the plug, and the plug can connect to a receptacle. A plugging action connecting or disconnecting the plug and receptacle can make a trip connection between the trip jumper in the plug and mating trip contacts in the receptacle. The trip connection can permit a trip current through the trip jumper, and the trip current can disconnect one or more power contacts in the receptacle from a power source.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
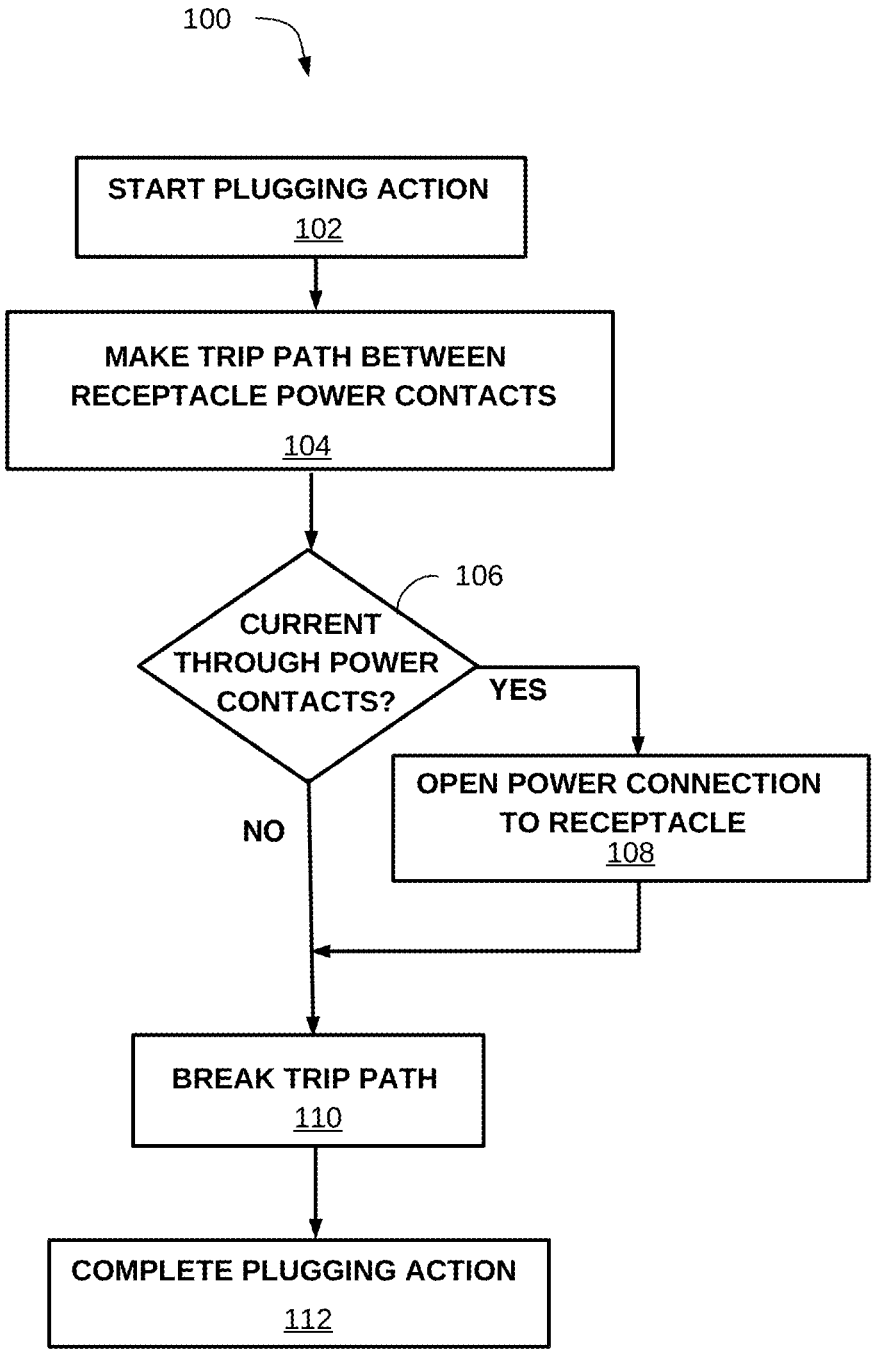
FIG. 1 is a flowchart illustrating an example method for preventing an electrical arc, according to aspects of the disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure (hereinafter, the disclosure) relate to connecting and/or disconnecting a power cord and plug, to or from an electrical device, to a power receptacle. In particular, the disclosure relates to protecting against electrical arc during connection to, and/or disconnection from a receptacle while electrical power is provided to the receptacle. While the present disclosure is not necessarily limited to such applications, various aspects of the disclosure may be appreciated through a discussion of various examples using this context.

As used herein, "electrical device" refers to an electrical, or electronic, device capable of receiving Alternating Current (AC) and/or Direct Current (DC) electrical power (hereinafter, "power") from an external power source. Examples of electrical devices include electric motors, computers or computer chassis, computing system elements (compute nodes in a multi-node computer, storage devices or subsystems, network gateways, etc.), power transformation systems (e.g. AC to DC transformer, or DC to AC inverters), and so forth.

An external power source for an electrical device can be electric utility power, utility other sources of power provided within a building, transformed (e.g., AC to DC) power whether utility or other sources). An electrical power source can be a mobile power source, such as a vehicle-mounted, or other mobile, electrical power generator. An external power source can be, for example, a power distribution rack. Such a rack can receive utility power from another power source and provide receptacles to plug electrical devices such as, for example, a computer, or nodes of a multi-node computer or computing system. As used herein, "facility" refers to any such source of power to which an electrical device can connect to receive power.

Conventionally, a plug at one end of a power, or "line" cord, connected to an electrical device, can connect to a facility receptacle to receive facility power to provide to the device. A facility receptacle (hereinafter, "receptacle") is typically associated with the facility itself, such as attached to, or built into, a facility wall or power distribution chassis. A line cord and plug are then typically associated with an electrical device to connect to the receptacle to draw facility power. The plug and receptacle include mating power contacts of particular electrical polarities, such as AC and/or DC positive and negative polarity contacts, AC neutral polarity contacts, individual phase polarity contacts in a multi-phase AC power facility, and (in some embodiments) a ground polarity contact.

A plug and receptacle can connect by various means, such as pins (e.g., on a plug) and mating sockets (e.g., in a receptacle). While a plug can be associated with pins, and a receptacle with sockets, a receptacle can, alternatively include pins (sometimes recessed within a cavity into which a plug inserts) and a plug includes mating sockets. Other embodiments of receptacles and plugs can include other forms or types of contact points, such as raised or sliding metal contacts on each of the plug and receptacle designed to mate to each other when the plug is connected to the receptacle. It would be apparent to one of ordinary skill in the art that a contact can be any form or design of an electrically conductive surface on each of a plug and receptacle that can mate when the plug and receptacle are connected.

As used herein, "plugging action" refers to any action connecting or disconnecting a plug and a receptacle. While it can be the case that facility power is disconnected, or shut off, from a receptacle prior to a plugging action, performing a plugging action while the receptacle is energized (i.e., receiving power) can occur. As used herein, a "hot plug" or, interchangeably, "hot plugging", action refers to a plugging action performed while the receptacle is connected to and receiving power (e.g., one or more power contacts in the receptacle are connected to a facility power source).

Hot plug actions can present electrical safety hazards. As one example, when connecting a plug to, or disconnecting a plug from, an energized receptacle (referred to herein, respectively, as a "connection event" and "disconnection event"), a sudden, uncontrolled surge of power to the electrical device can result in injury to a human performing the hot plug action, and/or damage to the device, the plug and/or receptacle, or other equipment within or connected to facility power.

As another example, during a connection event, as power contacts (e.g., pins) of the plug get within a particular distance of energized receptacle power contacts (e.g., sockets), prior to the plug and receptacle power contacts making contact with each other, an uncontrolled electrical "arc" (hereinafter, "arc") can occur, through the intervening air, between the plug contacts and receptacle contacts. Similarly, when disconnecting a plug from an energized receptacle, as power contacts (e.g., pins) of the plug break connection with energized power contacts (e.g., sockets) of a receptacle, an uncontrolled arc can occur between plug and receptacle power contacts. In both cases, the flow of electric charge through a normally non-conductive medium (e.g., air) into a nearby conductive material can pose an electrical safety hazard.

An equation known as "Paschen's Law" gives the voltage necessary to start an electric arc in a gas as a function of pressure and gap length. A connection event involving high voltage AC or DC power (e.g., 120 to 480 Volts AC, or 380 to 520 Volts DC) can result in an arc between power contacts of a plug and receptacle at small distances (e.g., within about a millimeter) between them. Arcs associated with a connection event can pose electrical hazards but may be contained in (i.e., the electrical arc held within) the space between the plug and receptacle and extinguished as the plug and receptacle make full contact.

In contrast, an arc associated with a disconnection event can be drawn out and away from the receptacle. As contact is broken between a plug and an energized receptacle, an effect known as the Townsend Avalanche can result in electrical arcs, at the voltage of the facility power, extending outward from the receptacle to the plug for several millimeters and, correspondingly, can energize nearby conductive devices or materials, or a human performing a hot disconnection action. Such arcs can deliver potentially instantaneous high current flow, outside of the receptacle, which can pose a risk of electrocution, or damage to other nearby devices. Accordingly, embodiments of the disclosure (hereinafter, "embodiments") can prevent electrical arc when connecting or disconnecting a plug and receptacle when the receptacle, and/or power contacts within the receptacle, are energized.

FIG. 1 illustrates example method 100 to prevent arcing during a hot plugging action. Method 100 can be embodied, for example, by varying designs of a plug and/or receptacle. Accordingly, to illustrate the method but not intended to limit embodiments, the method is described in the context of a particular design of a plug and receptacle that are configured to create a temporary electrically conductive path between power contacts of the receptacle.

At 102, a plugging action is initiated. For example, at 102 a human can start to connect or disconnect the plug and a receptacle. At 104, while performing the plugging action, the plug and receptacle make a temporary electrically-conductive path, referred to herein as a "trip path", between at least two of the power contacts. If, at 106, the receptacle is receiving (or, connected to) power from a power source (e.g., facility power), the trip path draws power from one of the receptacle power contacts directly through the other receptacle power contact and, at 108, opens a connection (e.g., opens a circuit breaker) providing power to the receptacle.

For example, at 106 if one or more of the receptacle contacts has power connected to it, a current, referred to herein as a "trip current", can flow over the trip path between the receptacle power contacts. The trip current can, for example, cause a circuit breaker between the facility power and the receptacle, or one or more of the receptacle power contacts, to open and remove electrical power from the receptacle, or receptacle power contact(s). On the other hand, if at 106 there is not power to receptacle power contacts in the trip path (e.g., power is switched off to the receptacle), there is no trip current flow through the trip path to cause a breaker to break a connection between the facility power and receptacle is not broken (e.g., the circuit breaker is not opened).

At 110, as the plug and receptacle complete making the connection or disconnection, the plug and receptacle break the trip path and, at 112, the plugging action between the plug and receptacle completes. Completing the plugging action makes (when connecting the plug and receptacle) or breaks (when disconnecting the plug and receptacle) full contact between mating power contacts of each of the plug and receptacle.

As previously discussed, a receptacle and plug design that prevents electrical arcs during connection and disconnection events can reduce or prevent electrical hazards associated with arcing. FIGS. 2A, 2B, and 3-7 illustrate example receptacles and plugs that can prevent such arcs. In FIGS. 2B through 7, cross-hatched areas represent conventionally-used non-conductive materials of a plug and receptacle, such as plastic or rubber that may be used to form the body of a plug and/or receptacle. Also, while not necessarily shown in all of the drawings included in the present application, it would be understood by one of ordinary skill in the art that embodiments of a plug and/or receptacle can include ground contacts (e.g., pins and/or sockets) and that an electrical ground comprises an electrical "polarity" within the scope of the disclosure.

Conventional plugs and receptacles can have a plurality of power contacts (e.g., pins and/or sockets) and can have additional, unused (or, having an undefined use) contacts, or unused contact positions (e.g., locations within a plug and/or receptacle not configured with an actual contact but defined as locations for future placement of contacts). For example, a 5-pin form of a power plug and receptacle can include a positive, a negative, and a ground polarity power contact, and two additional, unused contact positions. Embodiments can employ unused contacts, such as these, to implement a mechanism to prevent an arc when connecting or disconnecting the plug and receptacle.

Figure 2A:
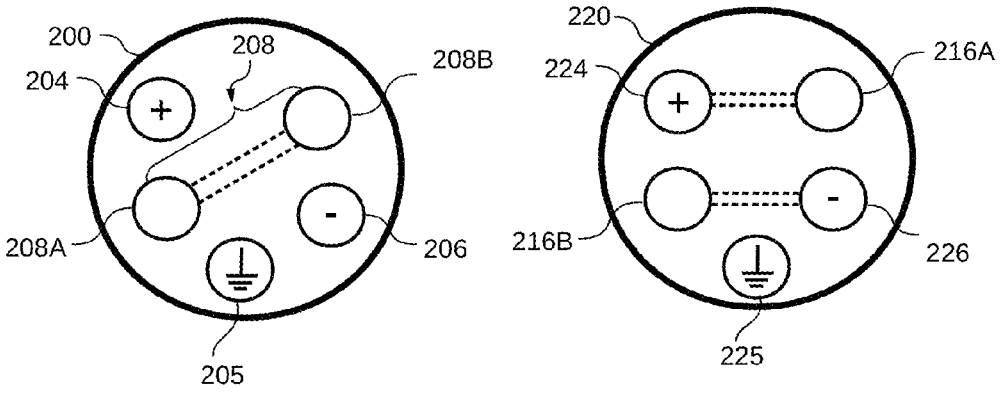
FIG. 2A illustrates an orientation of contacts in an example electrical receptacle and plug, according to aspects of the disclosure.
Figure 2B:
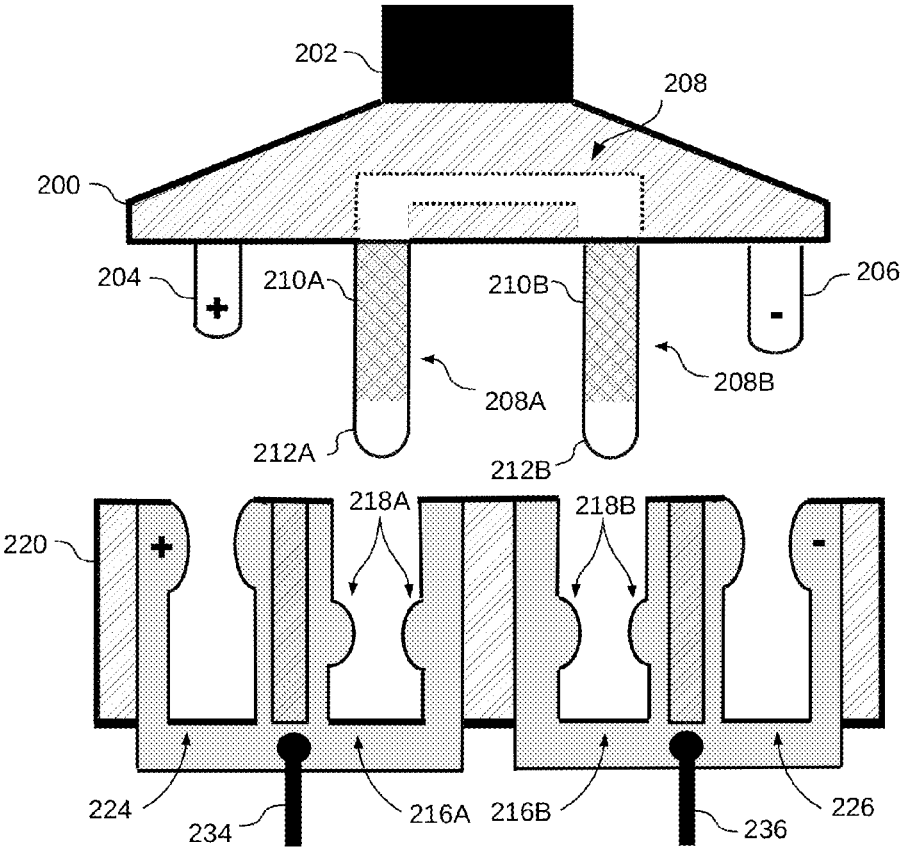
FIG. 2B illustrates a side view of an example electrical receptacle and plug, according to aspects of the disclosure.

FIG. 2A illustrates a top view of example plug 200 and a top view of example receptacle 220 having unused contacts. FIG. 2B illustrates a side view of plug 200 and receptacle 220 in more detail. Example plug 200 and receptacle 220 are shown in FIGS. 2A and 2B having a 5-pin configuration, such as previously described. In FIG. 2A the top view of plug 200 shows an example orientation of 5 contacts, within the body of the plug, that includes positive polarity power contact 204, negative polarity power contact 206, and ground polarity power contact 205. Plug 200 further includes unused contacts 208A and 208B. Contacts 208A and 208B are connected internal to plug 200, indicated by dashed, hidden lines. Connecting contacts 208A and 208B in this manner forms "trip jumper" 208, described in more detail in the description of FIG. 2B to follow. Plug 200 can connect to an electrical device by means of a line cord (shown in FIG. 2B) connected to power contacts 204, 205, and 206.

The top view of receptacle 220, in FIG. 2A, shows an orientation of 5 contacts, within the body of receptacle 220, configured to mate with corresponding contacts of plug 200, when plug 200 and receptacle 220 are connected. Accordingly, receptacle 220 includes positive polarity power contact 224, negative polarity power contact 226, and ground polarity power contact 225. Receptacle 220 further includes unused contacts 216A and 216B. Contacts 216A and 216B are connected, within receptacle 220 (indicated by dashed, hidden lines) to positive polarity power contact 224 and negative polarity power contact 226, respectively.

FIG. 2B is a side view of plug 200 and receptacle 220 that further illustrates the plug and receptacle in more detail. In FIG. 2B, where elements of FIG. 2B are identical to elements of FIG. 2A, identical reference numbers are used to identify the elements. To simplify the illustration, in FIG. 2B contacts included in plug 200 are shown as "pins" and contacts included in receptacle 220 are shown as "sockets" into which pins of plug 200 can be inserted to connect the plug and receptacle. However, the examples of FIGS. 2A and 2B are not intended to limit embodiments, and other forms or types of mate-able contacts can be used in a plug and mating receptacle. It would be apparent to one of ordinary skill in the art that mating contacts in a plug and receptacle can have geometries, configurations, and/or mating schemes other than as shown in FIGS. 2A and 2B. It would be further apparent to one of ordinary skill in the art that other configurations of power and/or ground contacts, with additional, unused contact positions, and other orientations thereof, are possible. Additionally, while not shown in FIG. 2B, ground pin 205 and ground socket 225 of FIG. 2A would be understood by one of ordinary skill in the art to be present in plug 200 and receptacle 220 of FIG. 2B.

As shown in FIG. 2B, receptacle 220 sockets 224 and 226 connect to wires 234 and 236, respectively, which can, in turn, connect to facility positive and negative polarity power. Plug 200 can connect to an electrical device by means of electrical wires (not shown) within line cord 202 and connected to power contacts 204, 205, and 206. For clarity of the illustration of FIG. 2B and FIGS. 3 through 5, plug 200 ground pin 205 and mating receptacle 220 ground socket 225 are omitted from those figures, but are understood to be otherwise present in each of plug 200 and receptacle 220, as illustrated in FIG. 2A.

In the context of plug 200 having pin contacts, and receptacle 220 having socket contacts, it can be seen from FIG. 2B that pin 204 can mate with socket 224, trip jumper 208 pin 208A can mate with socket 216A, trip jumper 208 pin 208B can mate with socket 216B, and pin 206 can mate with socket 226. FIG. 2B further shows trip jumper 208 pins 208A and 208B each having respective electrically non-conductive regions 210A and 210B, and respective electrically conductive tips 212A and 212B.

Trip sockets 216A and 216B each include, respectively, contact points 218A and 218B designed to contact conductive tips 212A and 212B, respectively, during a plugging action, to make a "trip connection". The trip connection creates a trip path through trip jumper 208, between trip sockets 216A and 216B and, in turn, between wires 234 and 236. As will be seen in the description of FIGS. 4 and 5, when wires 234 and/or 236 are connected to a power source (e.g., facility power) the trip path can permit a trip current to flow on the trip path. It will be understood that references, herein, to conductive tips 212A and 212B making a trip connection with receptacle 220 trip contacts 216A and 216B implies conductive tips 212A and 212B making a trip connection with contact points 218A and 218B in each of respective trip contacts 216A and 216B.

Plug 200 pins 204, 206, 208A, and 208B, and trip sockets 216A and 216B within receptacle 220, can be configured such that when connecting plug 200 and receptacle 220, conductive tips 212A and 212B make a trip connection with trip contacts 216A and 216B prior to pins 204 and 206 making contact with the respective sockets 224 and 226.

For example, trip pins 208A and 208B can be configured in plug 200 to be longer than plug power pins 204 and 206 and trip contacts 216A and 216B can be configured within receptacle 220 such that, when connecting plug 200 to receptacle 220, conductive tips 212A and 212B make a trip connection with trip contacts 216A and 216B prior to pins 204 or 206 making contact with respective contacts 224 and 226. Conductive tips 212A and 218B can each be a relatively short fraction (e.g., approximately 5 to 10 percent) of the length of respective trip pins 208A and 208B, with non-conductive regions 210A and 210B comprising the remaining length of respective trip pins 208A and 208B. Conductive tips (or, region) 212A and/or 212B of respective trip pins (or, contacts) 208A and 208B can be, for example, a length sufficient to sustain, without damage, an instantaneous (e.g., short circuit) current, corresponding to a voltage of the receptacle power sockets, through the conductive tip but need not necessarily be any longer.

FIG. 2B illustrates an example length of trip pins 208A and 208B as relatively longer than power pins 204 and 206. As will be seen in more detail in reference to FIG. 4, trip pins 208A and 208B are configured to have a length, with respect to power pins 204 and 206, such that, when connecting plug 200 to receptacle 220, conductive tips 212A and 212B make a trip connection with respective trip sockets 216A and 216B to establish a trip path between trip sockets 216A and 216B through trip jumper 208, prior to either of pins 204 and 206 reaching a proximity to respective receptacle power sockets 224 and 226 likely to produce an electrical arc between pins 204 and/or 206 and the respective sockets 224 and 226 when power is present to either or both of power sockets 224 and 226.

Such proximity can depend on various factors but can be associated particularly with the breakdown voltage of the gas (e.g., air) between receptacle 220 and plug 200. For example, at higher voltages (e.g., 220 volts), the proximity at which an arc can occur between pins of a plug and sockets of a receptacle (or, other forms or geometries of plug and receptacle power contacts) can be greater than that of lower voltages (e.g., 110*y*). At some voltages, a proximity at which an arc can occur can be, for example, about 1 millimeter, while at other (e.g., higher) voltages the proximity can be, for example, about several millimeters.

FIG. 2B further illustrates placement of trip contact points 218A and 218B at an example depth within respective trip sockets 216A and 216B such that, when plug 200 and receptacle 220 are fully connected (as will be described in more detail with reference to FIG. 3), conductive tips 212 A and B do not make a trip connection with receptacle trip contacts 216A and 216B, and do not form a trip path through trip jumper 208. For example, contact points 218A and 218B can be placed at a depth in the respective trip sockets 216A and 216B sufficiently less than the length of the non-conductive regions of a trip pins 208A and 208B, such that when the plug and receptacle are fully connected, and trip pins 208A and 208B are fully inserted into receptacle 220 trip sockets 216A and 216B, conductive tips 212A and 212B do not make a trip connection with receptacle trip contacts 216A and 216B.

Pins 204, 206, 208A, and 208B, and trip sockets 216A and 216B within receptacle 220, can be further configured such that when disconnecting plug 200 and receptacle 220, conductive tips 212A and 212B make a trip connection with trip contacts 216A and 216B prior to either of pins 204 and 206 breaking contact with the respective sockets 224 and 226. For example, as will be seen in more detail in reference to FIG. 5, placement of contact points 218A and 218B at the example depth within receptacle trip contacts 216A and 216B and sizing of the length of conductive tips 212A and 212B on respective trip pins 208A and 208B can enable conductive tips 212A and 212B to make a trip connection with respective trip contacts 216A and 216B prior to either of pins 204 and 206 breaking contact (and, thereby preventing a potential arc) with the respective power sockets 224 and 226 when plug 200 is unplugged from receptacle 220.

While FIGS. 2A, and 2B-5 illustrate example, relative relationships between the length of a trip and power pins in a plug, non-conductive and conductive regions of a plug trip jumper, and placement of trip contacts within trip pin sockets of a receptacle, particular lengths and/or depths, or other particular geometries of plug and receptacle trip contacts will depend on particular design and/or geometries of the plug and receptacle, and their respective power and trip contact types and/or geometries, and the particular voltages of power provided through the receptacle to the plug. Accordingly, determination of such particular lengths and/or depths, or other particular geometries of plug and receptacle trip contacts, can be done by, for example, laboratory measurements directed to those geometries and/or voltages.

Figure 3:
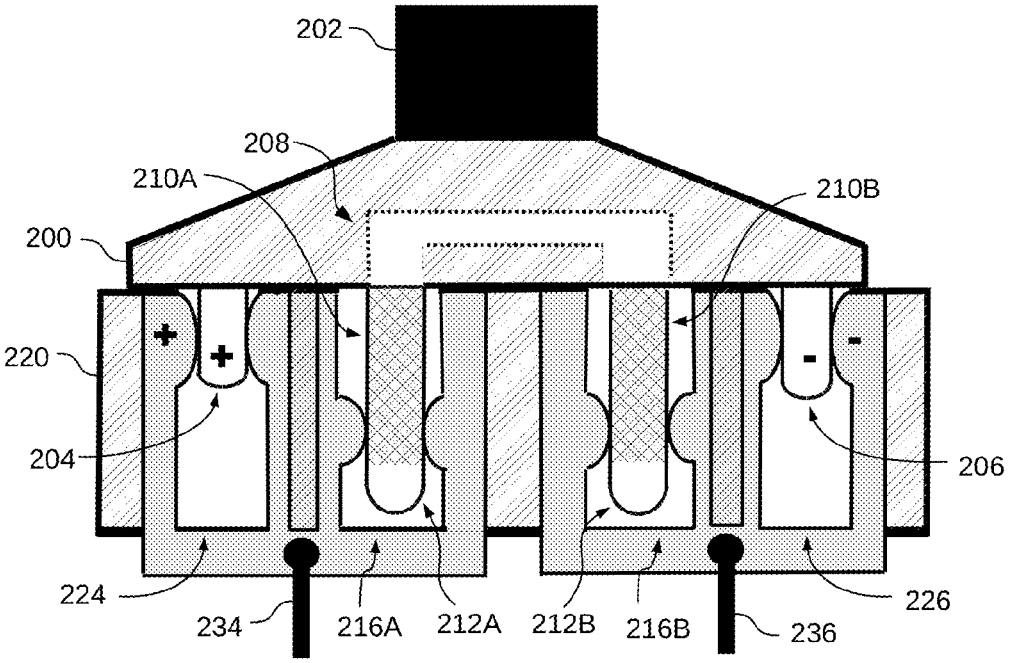
FIG. 3 illustrates an example plug fully mated to an electrical receptacle, according to aspects of the disclosure.

As will be seen in FIG. 3, the non-conductive regions 210A and 210B of trip jumper 208 operate to prevent an electrical current through trip jumper 208 when the plug and receptacle are fully connected. Non-conductive regions 210A and 210B can be formed as, for example, a non-conductive (or, alternatively, insulating) coating material, such as carbon, graphite, plastic, or a ceramic material, deposited on trip jumper 208. In alternative embodiments, non-conductive regions 210A and 210B can be formed entirely of such non-conductive materials, or combinations of such non-conductive materials. Additionally, the body of plug 200 (illustrated by the cross-hatched region of plug 200) in which trip jumper 208 is contained, is generally a non-conductive material, such that pins 204, 206, and trip jumper 208 are electrically insulated from each other within plug 200.

In contrast, electrically conductive tips 212A and 212B can be any type of conductive material (e.g., any of a variety of metals) that has an electrical resistance sufficiently low, in comparison to a voltage applied to them, to permit a trip current to flow through trip jumper 208. For example, tips 212A and 212B (and/or, the electrical connection, in trip jumper 208, between them) can have a relatively low resistance (e.g., less than one Ohm) in comparison to a voltage (e.g., 120 or 240 volts) applied to them, which can then permit a trip current (e.g., 100 or more amps) to flow between trip contacts 216A and 216B, and in turn power contacts 204 and 206, when trip contacts 216A and 216B are in contact with conductive tips 212A and 212B of trip jumper 208. In another example, electrically conductive tips 212A and 212B (and/or, the electrical connection, in trip jumper 208, between them) can have a resistance sufficient to limit a trip current below an amperage that can damage tips 212A and 212B, trip jumper 208, and/or other components in an electrical circuit that includes trip jumper 208, but still permit a trip current with an amperage sufficient to disconnect power from one or more power sockets (e.g., 224 and/or 226) in receptacle 220.

Figure 4:
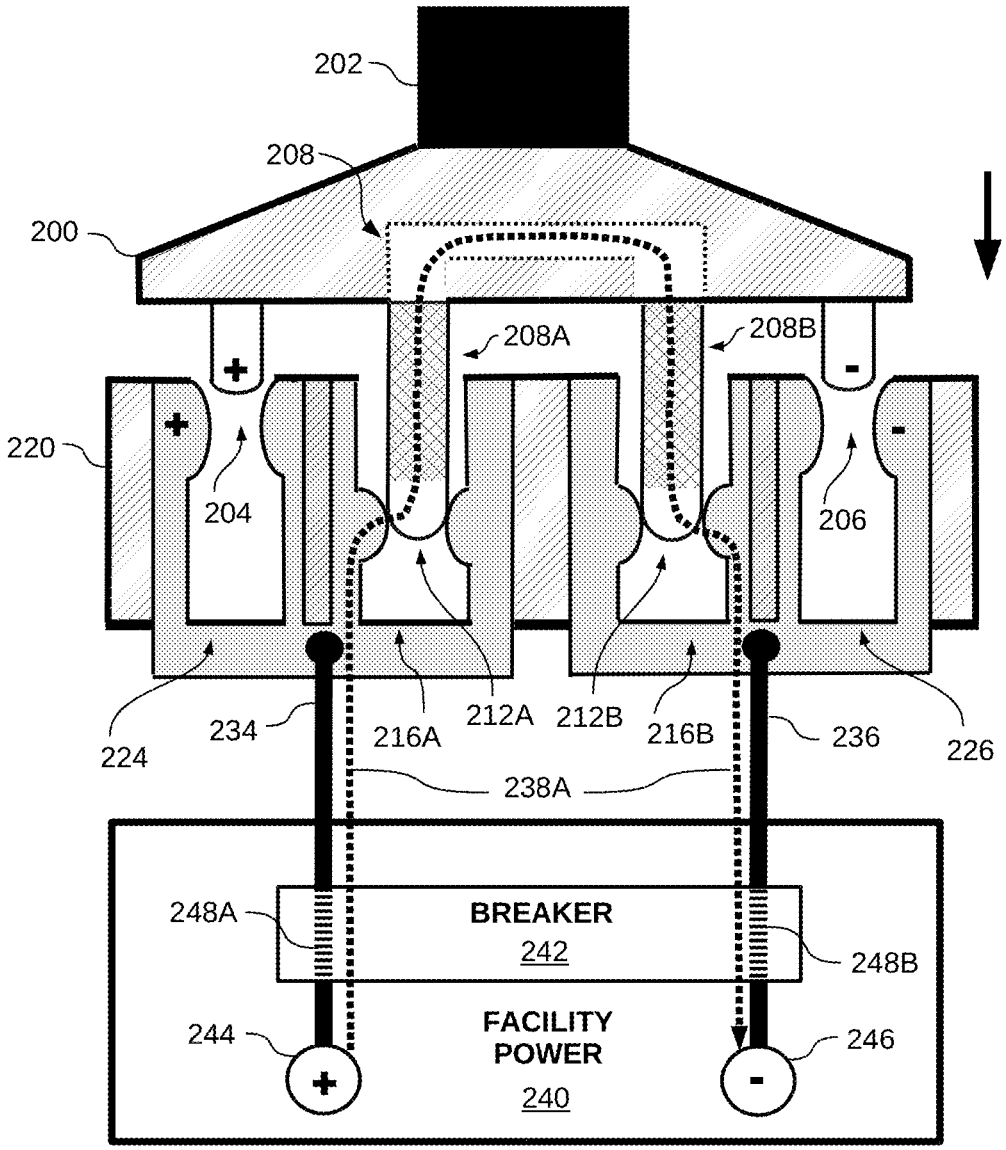
FIG. 4 illustrates an example trip current flow during connection to a receptacle, according to aspects of the disclosure.
Figure 5:
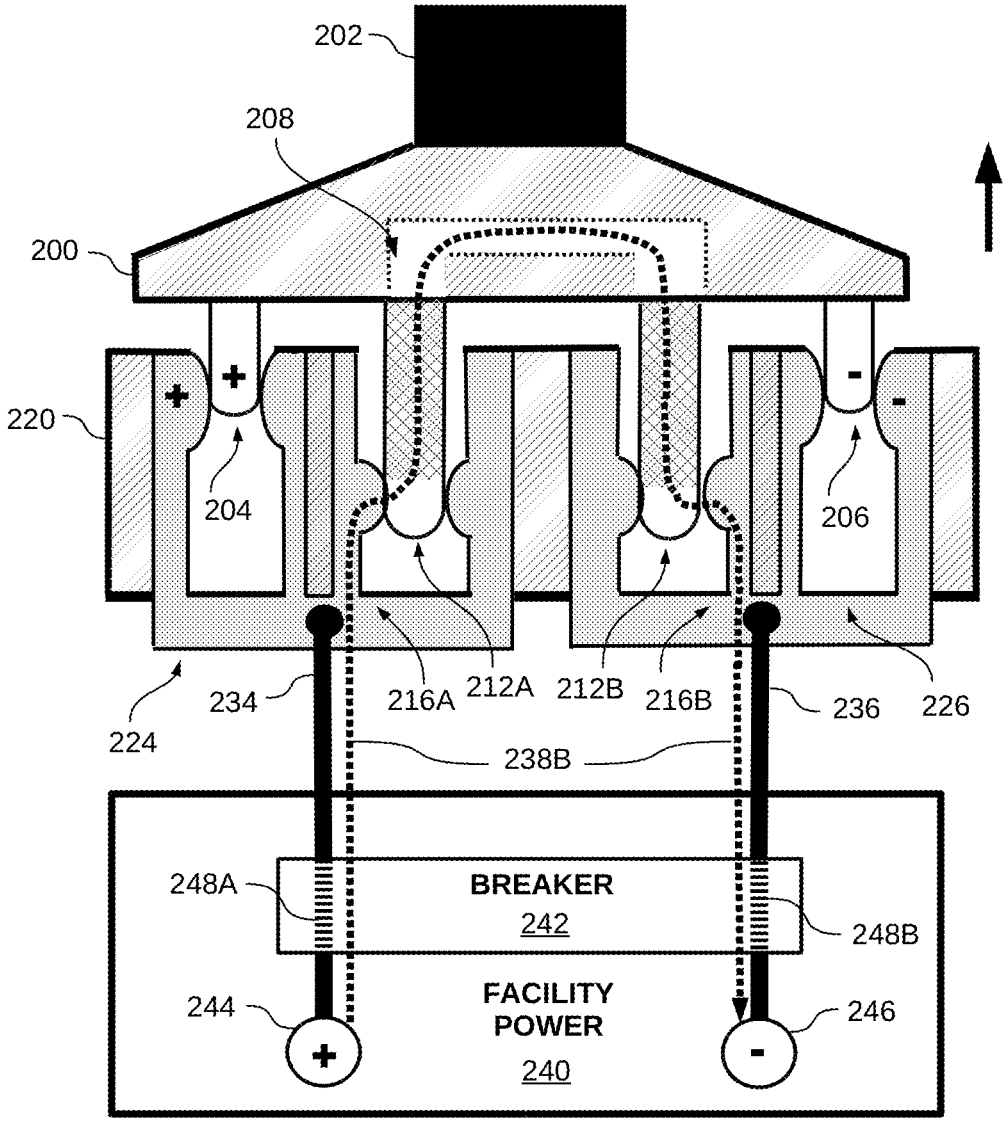
FIG. 5 illustrates an example trip current flow during disconnection to a receptacle, according to aspects of the disclosure.

FIG. 2B illustrates example plug 200 and example receptacle 220 in a fully disconnected configuration. FIGS. 3, 4, and 5 illustrate example plug 200 and receptacle 220 in a fully connected configuration, in a process of connecting the plug and receptacle, and in a process of disconnecting the plug and receptacle, respectively. Where elements of FIGS. 3, 4, and 5 are identical to elements of a preceding figure, FIGS. 3, 4, and 5 utilize identical reference numbers from the preceding figure(s) to identify the identical elements.

FIG. 3 illustrates plug 200 and receptacle 220, of FIG. 2, in a fully connected configuration. As shown, plug 200 trip jumper 208 and receptacle 220 are further configured such that when plug 200 is fully connected to receptacle 220, pins 204 and 206 are in contact with receptacle 220 sockets 224 and 226, respectively. Also, when plug 200 is fully connected to receptacle 220, trip jumper 208 is configured to interpose non-conductive regions 210A and 210B, of respective trip pins 208A and 208B, between respective receptacle trip socket 216A and 216B (e.g., between contact points 218A and 218B). Receptacle 220 can be further configured so that when plug 200 is fully connected to receptacle 220, conductive tips 212A and 212B are not in contact with trip sockets 216A and 216B. For example, trip sockets 216A and 216B can be relatively deeper than the length of trip pins 208A and 208B, or the regions of sockets 216 and/or 216B other than respective contact points 218A and 218B can be non-conductive, so that conductive tips 208A and/or 208B are not in electrically conductive contact with respective trip sockets 216A and 216B.

While FIG. 3 illustrates each of trip jumper contacts 208A and 208B having a non-conductive region (210A and 210B), it can be further seen in FIG. 3 that if only one of contacts 208A and 208B has the non-conductive region configured as shown in FIG. 3, that trip jumper 208 does not create a conductive, or tripping, path between sockets 216A and 216B when plug 200 is fully connected to receptacle 220.

A power facility can include a circuit breaker to protect the facility power from current loads above a particular facility rated power or current capacity, and in particular instantaneous high currents. A conventional circuit breaker can sustain power, or current, loads above a particular, rated capacity for a certain period of time, so as to avoid premature opening of a circuit (e.g., in response to a short term increase in current load when starting an electrical motor). However, conventional circuit breakers can also be designed to "trip", or open the breaker contacts, in response to a current load that is within an "instantaneous switching range" of the breaker. An instantaneous switching range can correspond, for example, to a current exceeding a particular level (e.g., 8 or more times the current rating of the circuit breaker).

Some conventional circuit breakers can open a power circuit within a very short time of experiencing a current within an instantaneous switching range of the breaker, such as, for example, about $1/60^{th}$ of a second (1 cycle of 60 Hz AC), or about 167 milliseconds. The time to open the circuit is much less than the amount of time for a human to connect or disconnect a plug and receptacle, which is normally on the order of a full second or more. Opening the breaker contacts, during a connection event, within a very short period of time, such as about 10 to 20 milliseconds, can remove power to the receptacle prior to the power contacts of the plug and receptacle reaching a proximity to cause an arc.

A trip path between power contacts in a receptacle, such as made by a trip connection between a trip jumper and mating trip contacts within a receptacle, can result in a trip current through the power contacts in the instantaneous switching range of a facility circuit breaker. Accordingly, in embodiments, creating a trip path between different polarity power contacts (e.g., a positive and negative contact, or between a positive or negative contact and a ground contact) during a connection or disconnection event, can result in a trip current through a facility breaker that disconnects power from the receptacle, thereby preventing an arc between plug and receptacle contacts.

FIG. 4 illustrates a connection event, connecting plug 200 and receptacle 220 with one or both of receptacle power sockets 224 and 226 receiving power from facility power 240. In FIG. 4, facility power 240 includes circuit breaker 242, which can open and close breaker contacts 248A and 248B to disconnect or connect, respectively, power to respective wires 234 and 236. Receptacle 220 receives power from facility power 240 by means of wire 234 connecting receptacle socket 224 to facility positive polarity power 244, through breaker contact 248A, and wire 236 connecting receptacle socket 226 to facility negative polarity power 246 through breaker contact 248B.

As shown in FIG. 4, plug 200 and receptacle 220 are configured such that when connecting plug 200 to receptacle 220, trip jumper 208 conductive tips 212A and 212B make a trip connection with respective trip sockets 216A and 216B prior to pins 204 and 206 making contact with the respective sockets 224 and 226. For example, trip jumper 208 pins 208A and 208B can be configured to be longer than plug power pins 204 and 206 and trip sockets 216A and 216B can be configured within receptacle 220 such that, when connecting plug 200 to receptacle 220, trip pins 208A and 208B—and, in particular, conductive tips 212A and 212B—make a trip connection with trip sockets 216A and 216B prior to pins 204 or 206 making contact with respective contacts 224 and 226.

When current loads are within the rated capacity of facility power 240 and breaker 242, breaker 242 closes breaker contacts 248A and 248B to permit current to flow between facility power polarities 244 and 246 and wires 234 and 236, respectively. However, making a relatively low resistance (in comparison to power voltage) path between differing facility power polarities, such as between polarities 244 and 246, can result in a trip current within an instantaneous switching range of breaker 242 and cause breaker 242 to open one or both of breaker contacts 248A and 248B, thereby disconnecting facility power 240 from receptacle 220.

Trip jumper 208 tips 212A and 212B making a trip connection with receptacle trip sockets 216A and 216B, can create a trip path between facility positive power wire 234 and facility negative power wire 236. As illustrated in FIG. 4, when connecting plug 200 to receptacle 220, as plug 200 is brought into contact with receptacle 220, prior to plug 200 pins 204 and 206 making contact with receptacle sockets 224 and 226, respectively, trip jumper 208 tips 212A and 212B make a trip connection with receptacle 220 trip sockets 216A and 216B to create the trip path between facility power wires 234 and 236.

When power is provided to the receptacle (e.g., one or both of contacts 224 and 226), the trip path allows trip current 238A to flow between sockets 224 and 226 and, correspondingly, between facility power positive polarity 244 and facility power negative polarity 246. If the conductive elements of plug 200 and receptacle 220 in that path have relatively low electrical resistance (approximately near zero Ohms), current 238A can be an instantaneous current within the instantaneous switching range of breaker 242, causing breaker 242 to open one or both of breaker contacts 248A and 248B and remove power to receptacle 220. Opening the facility breaker contacts within a period of time less than the typical time to connect a plug to a receptacle (e.g., less than about 200 milliseconds) and can remove power to the receptacle prior to the power contacts of the plug and receptacle becoming near enough to cause an arc.

FIG. 5 illustrates the example plug and receptacle of FIG. 2 during a disconnection event. As shown previously in FIG. 3, when plug 200 is fully connected to receptacle 220, no current flows between power sockets 224 and 226 through trip jumper 208. As illustrated in FIG. 5, as plug 200 is brought out of contact with receptacle 220 during a disconnection event, prior to plug 200 pins 204 and 206 breaking contact with receptacle sockets 224 and 226, respectively trip jumper 208 conductive tips 212A and 212B make a trip connection with receptacle 220 trip contacts 216A and 216B.

As was seen in the discussion of FIG. 4, trip jumper 208 tips 212A and 212B making a trip connection with receptacle 220 sockets 216A and 216B, when receptacle 220 is receiving power to sockets 224 and/or 226, can create a circuit path that allows trip current 238B to flow from facility power positive polarity 244 to facility power negative polarity 246. Like trip current 238A, trip current 238B can be within an instantaneous switching range of breaker 242, causing breaker 242 to open the breaker contacts and remove power to receptacle 220. Opening the breaker contacts within a period of time less than the typical time to disconnect a plug from a receptacle (e.g., less than about 200 milliseconds) can remove power to the receptacle prior to the power contacts of the plug and receptacle breaking contact and causing an arc.

In FIGS. 3-5, trip jumper 208 can be designed to sustain high trip currents, such as can result from a trip path between two differing polarities of a power source. Alternatively, trip jumper 208 can be designed as a "fuse", which melts, or otherwise breaks the connection between trip jumper pins 208A and 208B, when subjected to a trip current of a particular amperage through jumper 208, such as when creating a trip path between facility power polarities 244 and 246 in FIGS. 4 and 5. For example, this can be a safety precaution against the event that circuit breaker 242 fails and does not open contacts 248A and/or 248B. While circuit breaker 242 may continue to connects power to the receptacle through contacts 248A and/Or 248B, and an arc may then still be possible during a plugging action, current through the fuse can break the conductive trip path between sockets 224 and 226 and terminate trip current 238B. The fuse can be designed to break after a period of time longer than the time necessary for circuit breaker 242 to open in the instantaneous switching region.

Trip jumper 208 can be, further, a removable jumper capable of being replaced. For example, in the event that a trip jumper fails, or the connection between the trip jumper pins 208A and 208B is destroyed by a trip current, a removable trip jumper can be replaced in the plug with a new, or otherwise operable, trip jumper. The replacement can be performed, for example, in a facility installation, without necessarily returning the plug (or, line cord and plug) to a plug manufacturer to repair the plug.

While the examples of FIGS. 2A, 2B, and 3 through 5 illustrate creating a trip path in a receptacle prior to any of the plug power contacts (e.g., 204 and 206) making (in a connection event), or breaking (in a disconnection event), contact with corresponding receptacle power contacts (e.g., 224 and 226), it would be apparent to one of ordinary skill in the art that the disclosure is not limited to such configurations. Alternative embodiments can be configured, for example, to make a trip connection between a plug trip conductive contact region (e.g., a tip of a trip pin) and receptacle trip contacts prior to at least one of any contacts that connect power through the line cord to a device that closes an electrical circuit.

In one such example, a plug and receptacle can be designed such that a plug trip contact conductive region makes a trip connection with the receptacle trip contacts (or, in an alternative embodiment, a single receptacle trip contact) prior to only one power contact of the plug contacting a respective mating contact in the receptacle. This can thereby prevent an arc during a connection event in the case, for example, that that only one power contact is required to close a circuit within the facility power. Similarly, in another example, a plug and receptacle can be designed such that plug trip contact conductive regions make a trip connection with the receptacle trip contacts (or, in an alternative embodiment, a single receptacle trip contact) prior to any of the power contacts of the plug breaking contact with a respective mating contact in the receptacle, thereby preventing an arc during a disconnection event.

Figure 6:
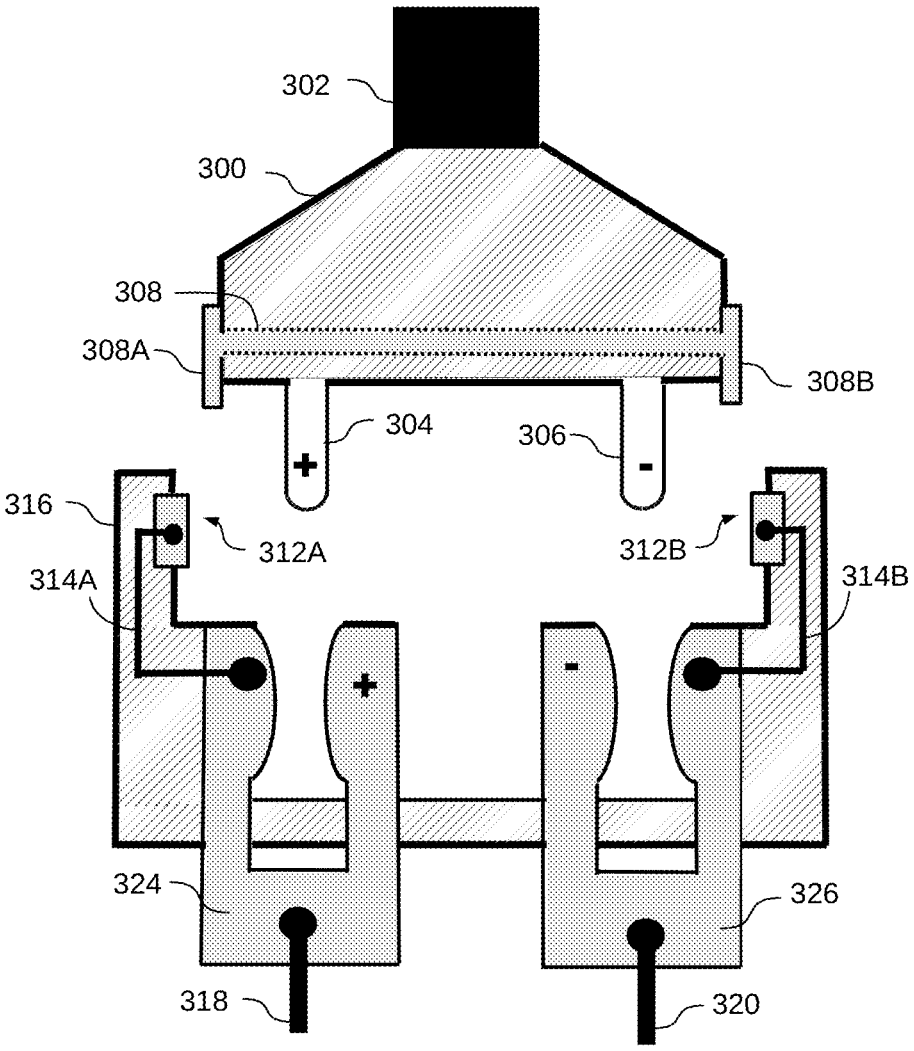
FIG. 6 illustrates an alternative example configuration of trip contacts, according to aspects of the disclosure.

Also, while FIGS. 2A, 2B, and 3 through 5 illustrate example plug and receptacle configurations to create a trip path between the receptacle power contacts using pins in the plug and sockets in the receptacle, embodiments can create a trip path between receptacle (or, alternatively, plug) power contacts by other means. FIG. 6 illustrates an alternative example of a plug and receptacle having a different configuration of a trip jumper. In FIG. 6, example plug 300 has power contacts (pins) 304 and 306 which mate to receptacle 316 power contacts (sockets) 324 and 326, respectively. Plug 300 can connect to an electrical device by means of line cord 302, and receptacle contacts 324 and 326 can connect to facility power by means of wires 318 and 320, respectively. In the description of FIG. 6, "downward" and "upward" directions are with reference to the orientation of the example plug and receptacle as shown in FIG. 6. For example, the direction extending from the pins of plug 300 towards the line cord of plug 300 represents an "upward" direction, while the reverse direction represents a "downward direction".

Plug 300 includes trip jumper 308 comprising conductive jumper contacts 308A and 308B mounted on the outer surface of plug 300 (e.g., on a shell surrounding the body of plug 300) and connected within plug 300 (shown as dashed, hidden lines within the body of plug 300). Receptacle 316 similarly includes trip contacts 312A and 312B, mounted on inner surfaces of receptacle 316 (e.g., on a shell surrounding the body of receptacle 316) and connected, respectively, by means of wire 314A to positive power contact 324 and wire 314B to negative power contact 326 of the receptacle 316.

Plug 300 can be designed so that when connecting plug 300 and receptacle 316, the outer surface (e.g., a shell surrounding the body) of the plug inserts into the inner surface (e.g., a shell surrounding the body) of receptacle 316. Plug 300 and receptacle 316 can be configured such that the operation of connecting plug 300 and receptacle 316 trip contacts 308A and 308B make a trip connection with trip contacts 312A and 312B prior to plug power contacts 304 and 306 making contact with respective receptacle power contacts 324 and 326. For example, trip contacts 308A and 308B can extend downward from the body of plug 300, for a length relative to the length that one or both of power pins 304 and 306 extend downward from the body of plug 300, such that trip contacts 308A and 308B make a trip connection with trip contacts 312A and 312B of receptacle 316, during a connection operation, prior to plug 300 power contacts 304 and 306 contacting receptacle power contacts 324 and 326. The proximity of the plug and respective receptacle power contacts to each other, at the proximity of the plug and receptacle to each other in which the plug and receptacle trip contacts make a trip connection, can be a proximity greater than the proximity between the plug and receptacle power contacts that can produce an arc.

Plug 300 and receptacle 316 can be further configured such that the operation of disconnecting plug 300 and receptacle 302 makes a trip connection between 308A and 308B and trip contacts 312A and 312B, respectively, prior to plug power contacts 304 and 306 breaking contact with respective receptacle power contacts 324 and 326. For example, trip contacts 308A and 308B can extend upward from the bottom of the body of plug 300 for a length sufficient for trip contacts 308A and 308B to make a trip connection with trip contacts 312A and 312B of receptacle 316, during a disconnection operation, prior to either of plug 300 power contacts 304 and 306 breaking contact with receptacle power contacts 324 and 326, thereby preventing an arc.

In either case, if receptacle 316 is receiving facility power at either or both of receptacle contacts 324 and 326, trip contacts 308A and 308B making a trip connection with trip contacts 312A and 312B can create a trip current between facility power contacts connected to wires 318 and 320. As previously described, such a trip path can produce a trip current within an instantaneous switching range of a facility breaker, causing the breaker to open one or more breaker contacts to disconnect facility power from one or both of wires 318 and 320. Plug 300 and/or receptacle 316 can be further configured, similar to the configuration of plug 200 and receptacle 220 shown in FIG. 3, such that when plug 300 and receptacle 316 are fully connected (e.g., plug 300 is fully inserted into receptacle 316), trip contacts 308A and 308B are positioned below trip contacts 312A and 312B so as not to permit a trip current to flow through trip jumper 308.

Figure 7:
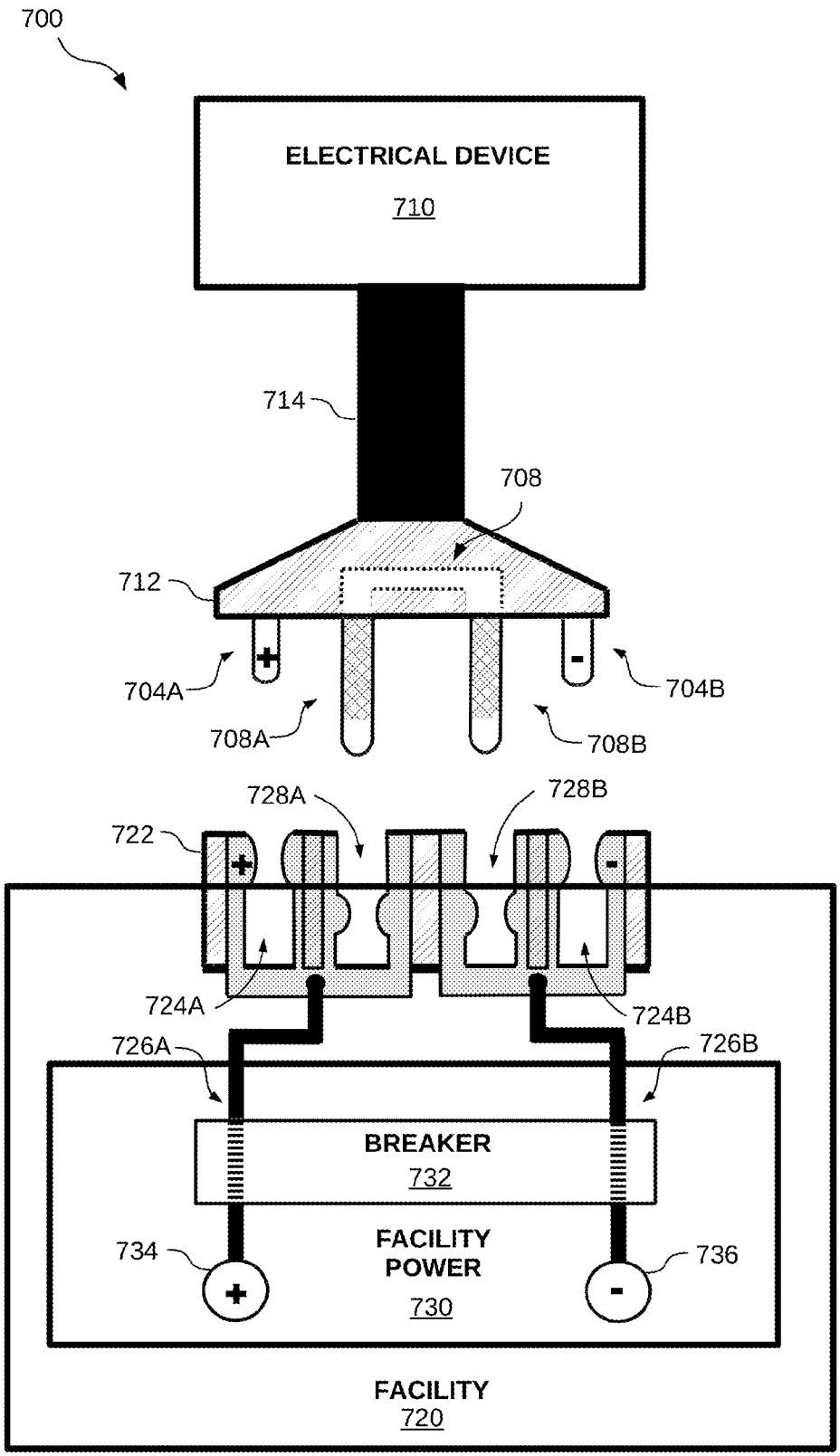
FIG. 7 illustrates an example system, according to aspects of the disclosure.

Embodiments can include a system with an electrical device having a plug with a trip jumper configured to connect to a receptacle having one or more trip contacts. FIG. 7 illustrates example system 700, which includes electrical device 710 having line cord 714 attached to plug 712, and facility 720 having receptacle 722, which can connect to plug 712. Electrical device 710 can be any device that receives electrical power from an external power source, such as a facility power source.

For example, electrical device 710 can be a computer (e.g., a laptop, desktop, server computer or a node of a multi-node server computer), a storage device or subsystem, a network device (e.g., a network gateway or router), an electrical motor, or an electrical power transformer (e.g., a voltage or current transformer). In some embodiments, electrical device 710 can be, for example, a power distribution rack, which can receive power from an external power source and distribute that power to multiple other devices connected to, or plugged into, power receptacles or connections within the power distribution rack. It would be apparent to one of ordinary skill in that art that embodiments can include electrical, and/or electronic, devices of a wide variety that receive electrical power from an external source.

Receptacle 722 connects to facility power 730 positive polarity power 734 and negative polarity power 736 by means of breaker 732 connected to wires 726A and 726B. Wires 726A and 726B also connect to power contacts (sockets, as shown) 724A and 724B, respectively, and power sockets 724A and 724B are configured to mate with power contacts 704A and 704B, respectively, in plug 712.

Plug 712 has trip jumper 708 similar to that of plug 200 previously described. In alternative embodiments, a plug and receptacle can have trip jumper and receptacle trip contacts similar to those of plug 300 and receptacle 316 shown in FIG. 6. Accordingly, plug 712 is shown having trip jumper 708 configured to make a trip connection (such as previously described), when plug 712 and receptacle 722 are connected and/or disconnected, between jumper trip contacts 708A and 708B of plug 712 and trip contacts 728A and 728B, respectively, of receptacle 722.

Trip contacts 728A and 728B are configured to connect to receptacle power through connections to wires 726A and 726B, respectively. Accordingly, in example system 700, a trip connection between jumper trip contacts 708A and 708B and trip contacts 728A and 728B can create a trip path between receptacle power polarities 734 and 736. A corresponding trip current through trip jumper 208 can cause breaker 732 to disconnect one or both of wires 726A and 726B from their respective power polarities 734 and 736 in facility power 730.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A power plug comprising:

a plurality of plug power contacts; and a plug trip jumper, wherein the plug trip jumper comprises a first and a second jumper contact electrically coupled to each other, the first and second jumper contacts electrically coupled to each other permitting a current to flow through the plug trip jumper, and wherein each of the first and second jumper contacts comprises a respective electrically conductive tip and a respective electrically non-conductive region; and wherein each of the first and second jumper contacts are configured to make a trip connection, during a plugging action with the power plug and a power receptacle, with respective mating receptacle trip contacts included in the power receptacle;

wherein, the respective electrically conductive tip of each of the first and second jumper contacts is configured to make the trip connection with the respective mating receptacle trip contact;

wherein at least one of the first and second jumper contacts is further configured such that, when the power plug is fully connected to the power receptacle, the respective electrically conductive tip does not make the trip connection with the respective mating receptacle trip contact and the respective electrically non-conductive region is placed in contact with the respective mating receptacle trip contact, thereby preventing the trip current through the plug trip jumper;

wherein the trip connection permits a trip current through the plug trip jumper when at least one receptacle power contact, included in the power receptacle, is connected to electrical power provided by a power source; and wherein the trip current causes disconnection, from the electrical power, of the at least one receptacle power contact among the at least one receptacle power contact connected to the electrical power.

2. The power plug of claim 1, wherein at least one of the first and second jumper contacts is further configured to break the trip connection with the respective mating receptacle trip contact when completing the plugging action; and wherein, when the trip current is present through the plug trip jumper, the breaking the trip connection terminates the trip current.

3. The power plug of claim 1, wherein the first and second jumper contacts are further configured to make the trip connection with the respective mating receptacle trip contacts, when the plugging action is an action connecting the power plug to the power receptacle, prior to any of the plurality of plug power contacts reaching a proximity to produce an electrical arc with any of the at least one receptacle power contacts connected to the electrical power.

4. The power plug of claim 1, wherein the first and second jumper contacts are further configured to make the trip connection with the respective mating receptacle trip contact, when the plugging action is an action disconnecting the power plug and the power receptacle, prior to any of the plug power contacts, among the set of plug power contacts, in contact with a respective mating power contact in the receptacle breaking the contact with the respective mating power contact in the power receptacle.

5. The power plug of claim 1, wherein each of the plurality of plug power contacts is configured to conduct electrical power comprising one of a direct current (DC) positive polarity, a DC negative polarity, a DC ground, an alternating current (AC) positive polarity, an AC negative polarity, an AC neutral, and a phase of a multi-phase AC.

6. The power plug of claim 1, wherein each of the first and second jumper contacts are located on one of an outer surface of the power plug and within the body of the power plug.

7. The power plug of claim 1, wherein the plug trip jumper is configured to be replaceable.

8. A system comprising:

an electrical device;

a line cord comprising a plurality of electrical wires and a power plug, wherein the line cord and the plurality of electrical wires connect the electrical device to the power plug, wherein the power plug comprises a plurality of plug power contacts, each of the plurality of plug power contacts coupled to a respective electrical wire included in the plurality of electrical wires of the line cord, and wherein the power plug further comprises a plug trip jumper having a first and a second jumper contact electrically coupled to each other to permit a current to flow through the plug trip jumper, and wherein each of the first and second jumper contacts comprises a respective electrically conductive tip and a respective electrically non-conductive region; and wherein each of the first and second jumper contacts are configured to make a trip connection, during a plugging action with the power plug and a power receptacle, with respective mating receptacle trip contacts included in the power receptacle;

wherein, the respective electrically conductive tip of each of the first and second jumper contacts is configured to make the trip connection with the respective mating receptacle trip contact;

wherein at least one of the first and second jumper contacts is further configured such that, when the power plug is fully connected to the power receptacle, the respective electrically conductive tip does not make the trip connection with the respective mating receptacle trip contact and the respective electrically non-conductive region is placed in contact with the respective mating receptacle trip contact, thereby preventing the trip current through the plug trip jumper;

wherein the trip connection permits a trip current through the plug trip jumper when the first and second jumper contacts make the trip connection with the mating receptacle trip contacts and at least one receptacle power contact, included in the power receptacle, is connected to electrical power provided by a power source; and wherein the trip current causes disconnection, from the electrical power, of the at least one receptacle power contact among the at least one receptacle power contact connected to the electrical power.

9. The electrical system of claim 8, wherein at least one of the first and second jumper contacts is further configured to break the trip connection with the respective mating receptacle trip contact when completing the plugging action; and wherein, when the trip current is present through the plug trip jumper, the breaking the trip connection terminates the trip current.

10. The electrical system of claim 8, wherein the first and second jumper contacts are further configured to make the trip connection with the respective mating receptacle trip contacts, when the plugging action is an action connecting the power plug to the power receptacle, prior to any of the plurality of plug power contacts reaching a proximity to produce an electrical arc with any of the at least one receptacle power contacts connected to the electrical power.

11. The electrical system of claim 8, wherein when the plugging action is an action disconnecting the power plug and the power receptacle, the first and second jumper contacts are further configured to make the trip connection with the respective mating receptacle trip contacts prior to any of the plug power contacts, among the set of plug power contacts, in contact with a respective mating power contact in the receptacle breaking the contact with the respective mating power contact in the power receptacle.

12. The electrical system of claim 8, wherein each of the plurality of plug power contacts is configured to conduct electrical power comprising one of a direct current (DC) positive polarity, a DC negative polarity, a DC ground, an alternating current (AC) positive polarity, an AC negative polarity, an AC neutral, and a phase of a multi-phase AC.

13. The electrical system of claim 8, wherein each of the first and second jumper contacts are located on one of an outer surface of the power plug and within the body of the power plug.

* * * * *